US005157178A

United States Patent [19]

Gajda et al.

[11] Patent Number: 5,157,178

[45] Date of Patent: Oct. 20, 1992

[54] PROCESS FOR PRODUCING OXYGENATED GASOLINE

[75] Inventors: Gregory J. Gajda, Mt. Prospect, Ill.; Jule A. Rabo, Westchester, N.Y.

[73] Assignee: UOP, Des Plaines, Ill.

[21] Appl. No.: 702,488

[22] Filed: May 20, 1991

Related U.S. Application Data

[63] Continuation-in-part of Ser. No. 477,016, Feb. 8, 1990, Pat. No. 5,057,635.

[51] Int. Cl.[5] ..... C07C 5/05; C07C 5/23; C07C 41/05

[52] U.S. Cl. ..... 585/259; 585/310; 585/666; 568/697

[58] Field of Search ..... 585/310, 328, 666, 259, 585/667; 568/697

[56] References Cited

U.S. PATENT DOCUMENTS

| | | | |
|---|---|---|---|
| 3,470,085 | 9/1969 | Parker | 585/841 |
| 4,257,885 | 3/1981 | Grose et al. | 423/329 |
| 4,581,474 | 4/1986 | Hutson et al. | 568/697 |
| 4,731,490 | 3/1988 | Coughenour et al. | 585/329 |
| 4,754,078 | 6/1988 | Vora et al. | 585/331 |
| 4,816,607 | 5/1989 | Vora et al. | 568/697 |
| 5,057,635 | 10/1991 | Gajda | 585/667 |

*Primary Examiner*—Anthony McFarlane

*Attorney, Agent, or Firm*—Thomas K. McBride; John F. Spears, Jr.; Richard E. Conser

[57] ABSTRACT

An improved process combination is disclosed for the production of an oxygenated gasoline component from an FCC gasoline feed. Olefins in the cracked gasoline are isomerized using a medium-pore molecular-sieve catalyst to achieve high yields of $C_5+$ isomerized gasoline and avoid conversion of highly branched paraffins to equilibrium values. The isomerized gasoline is etherified to obtain oxygenated gasoline.

18 Claims, 2 Drawing Sheets

PROCESS FOR PRODUCING OXYGENATED GASOLINE

CROSS REFERENCE TO RELATED APPLICATION

This application is a continuation-in-part of prior copending application Ser. No. 477,016, filed Feb. 8, 1990, now U.S. Pat. No. 5,057,635, the contents of which are incorporated herein by reference thereto.

BACKGROUND OF THE INVENTION

1. Field of the Invention

This invention relates to an improved process for the conversion of hydrocarbons, and more specifically for the production of oxygen-containing gasoline.

2. General Background

The widespread removal of lead antiknock additive from gasoline and the rising fuel-quantity demands of high-performance internal-combustion engines are increasing the need for "octane," or knock resistance, in the gasoline pool. Petroleum refiners have relied on a variety of options to upgrade the gasoline pool, including improved catalysts and processes for catalytic naphtha. The low-cost options for gasoline upgrading have been largely exploited, however, and refiners need new technology to address future gasoline-octane requirements.

Gasoline from catalytic cracking necessarily is a major target of octane-improvement efforts, as it typically amounts to 30 to 40% of the gasoline pool. Efforts to improve the cracking catalyst and process have resulted principally in increased gasoline aromatics content and reduction of low-octane components in the middle-boiling range. There is limited leverage to alter the cracking reaction to increase gasoline octane, however. The paraffin component has a higher-than-equilibrium ratio of isoparaffins to normal paraffins, and thus a higher octane than currently could be obtained by isomerization. The olefin component of the cracked gasoline has an equilibrium ratio of branched to unbranched olefins, and this can be changed only marginally in the cracking reaction.

A process for isomerizing olefins in catalytically cracked gasoline thus has considerable potential for improving the octane of the gasoline pool, but must address several problems. The process must not effect substantial isomerization of paraffins, in order to avoid changing the already-high ratio of isoparaffins to normal paraffins. The process should operate at relatively low temperature where the equilibrium ratio of branched to unbranched isomers is more favorable and by-products are minimized. An effective process also should solve the problem of highly unsaturated hydrocarbons in the feed such as acetylenes and dienes which could polymerize and foul the catalyst, thus requiring higher temperature to maintain catalyst activity and reducing catalyst life. A process combination including etherification of tertiary olefins produced by isomerization to obtain an oxygenated component would be particularly effective in upgrading catalytically cracked gasoline.

RELATED ART

Processes for the isomerization of olefinic hydrocarbons, including feedstocks in the gasoline range, are known in the art. U.S. Pat. No. 3,236,909 (Winnick) teaches isomerization of mono-olefins with a catalyst containing an acidic zeolite which has been neutralized with a buffered acidic solution to avoid polymer formation from tertiary olefins. U.S. Pat. No. 3,636,125 (Hoppstock) discloses a process using a specific molecular sieve to isomerize branched-chain 1-olefins to branched-chain 2-olefins. U.S. Pat. No. 3,751,502 (Hayes et al.) discloses the isomerization of mono-olefins using a catalyst comprising crystalline aluminosilicate in an alumna carrier. U.S. Pat. No. 4,324,940 (Dessau) teaches isomerization of smaller olefins having an effective critical dimension of 6.8 angstroms with an acidic zeolitic catalyst. U.S. Pat. No. 4,753,720 (Morrison) discloses a process for the isomerization of olefins in catalytically cracked gasoline at a temperature of at least 700° F. using an acidic zeolitic catalyst. None of the above references discloses the use of the present invention, combining removal of highly unsaturated compounds and an olefin isomerization step to address the problems described hereinabove.

Several methods of selectively removing small amounts of highly unsaturated hydrocarbons from a stock are known in the art. Clay treating for polymerization of small amounts of unsaturates is old and disclosed, for example, in U.S. Pat. No. 2,778,863 (Maisel). There also is a plethora of art on the selective hydrogenation of thermally cracked gasoline for diolefin reduction with a concomitant reduction in polymer and gum formation. Selective hydrogenation of pyrolysis gasoline at relatively low temperatures followed by higher-temperature hydrotreating are disclosed in U.S. Pat. Nos. 3,470,085 (Parker), 3,556,983 (Kronig et al.) and 3,702,291 (Jacquin et al.). However, it is believed that the prior art does not teach or suggest removal of highly unsaturated hydrocarbons prior to an olefin isomerization process.

U.S. Pat. No. 4,803,185 (Miller et al.) teaches the use of non-zeolitic molecular sieves in a multi-compositional catalytic cracking catalyst which effects an octane increase without the selectivity loss of the prior art. However, Miller does not suggest the present olefin isomerization process.

U.S. Pat. No. 4,581,474 (Hutson et al.) discloses MTBE production from mixed butenes, followed by skeletal isomerization of 1-butene to isobutene and recycle of the isobutene to MTBE production. A multistep process, including butane isomerization and dehydrogenation combined with MTBE production and butane recycle to isomerization, is taught in U.S. Pat. No. 4,816,607 (Vora et al.). Neither of these references suggest the present combination to isomerize catalytically cracked gasoline and etherify the resulting tertiary olefins.

The prior art, therefore, contains elements of the present invention. There is no suggestion to combine the elements, however, nor of the surprising benefits that accrue in an olefin-isomerization and etherification process combination.

SUMMARY OF THE INVENTION

Objects

It is an object of the present invention to provide an improved process for the isomerization of olefins in a feed stream containing highly unsaturated hydrocarbons. Other objectives are to improve the ratio of branched to unbranched olefins in the product, reduce the yield of by-products, increase the life of the olefin-isomerization catalyst and increase the oxygen content of the gasoline.

Summary

This invention is based on the discovery that olefins in a catalytically cracked gasoline stream can be isomerized effectively to increase the ratio of branched to unbranched olefins in a process which includes selective reduction of highly unsaturated hydrocarbons in the gasoline feed stream. The isomerized stream is particularly effective as an etherification feed to obtain an oxygenated component.

Embodiments

A broad embodiment of the present invention is directed to the processing of an olefin-containing gasoline-range feed stream in an isomerization zone, using an isomerization catalyst containing at least one medium-pore molecular sieve, followed by processing of isomerized gasoline in an etherification zone to produce an oxygenated gasoline component. The oxygen content of the component is increased relative to the corresponding oxygen content if the feed stream were processed by etherification without prior isomerization.

Preferably the feed stream is derived by the catalytic cracking of petroleum feedstocks heavier than gasoline. In an especially preferred embodiment, the isomerization zone is preceded by selective reduction of highly unsaturated hydrocarbons. Clay treating is a favored method of reducing the content of highly unsaturated hydrocarbons. An alternative method is selective hydrogenation of acetylenes and dienes.

Preferably, the ratio of branched to unbranched pentenes is increased in the isomerization zone to at least about 2. Optimally, the ratio of branched to unbranched olefins in the product will be about 3 or more and the net yield of $C_4$ and lighter by-products will be less than about 0.5%.

These, as well as other objects and embodiments, will become apparent from the detailed description of the invention.

DESCRIPTION OF THE PREFERRED EMBODIMENTS

Figure 1:
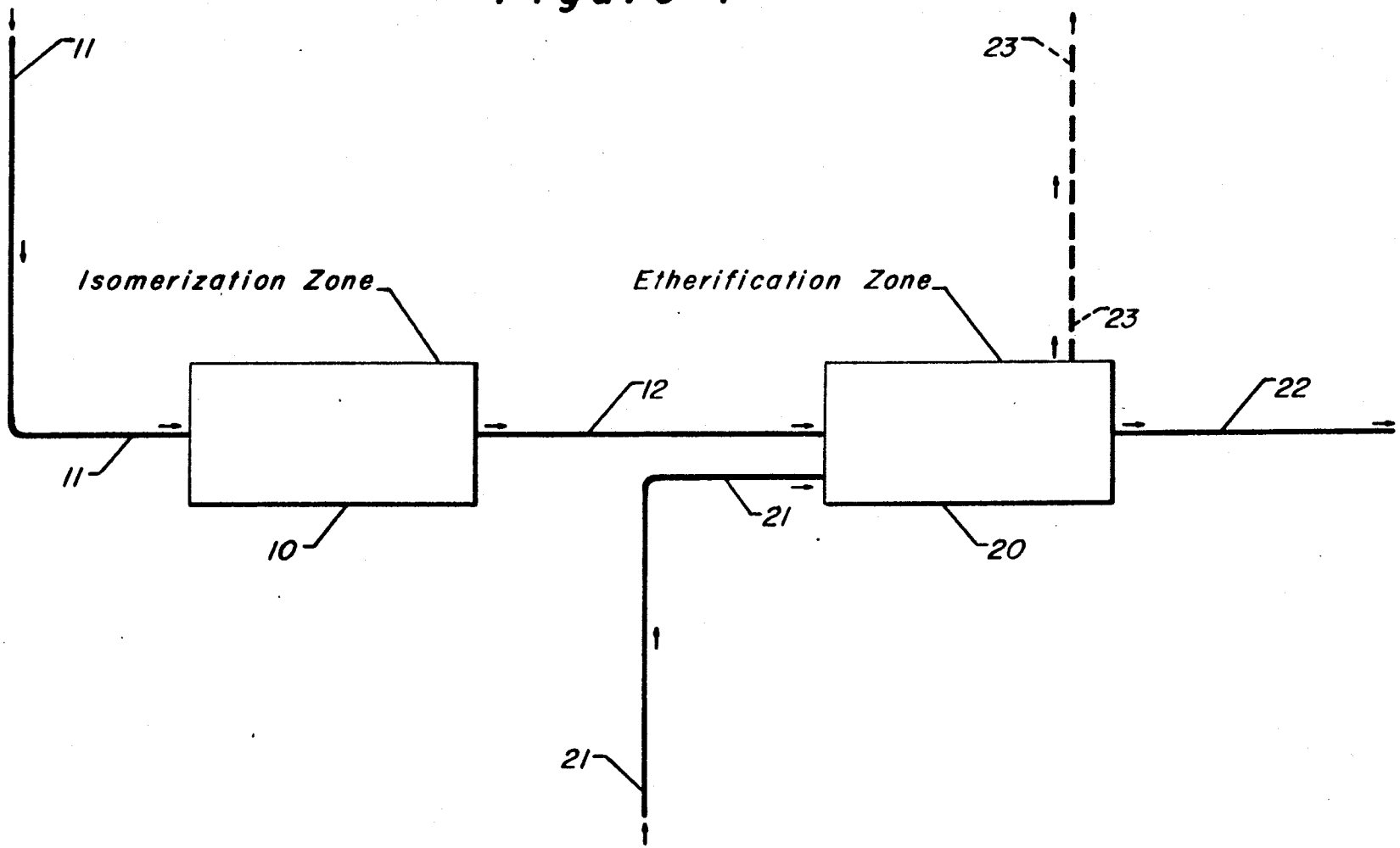
FIG. 1 is a simplified block flow diagram of a combination of isomerization and etherification steps.

To reiterate, a broad embodiment of the present invention is directed to the processing of an olefin-containing gasoline-range feed stream in an isomerization zone, using an isomerization catalyst containing at least one medium-pore molecular sieve, followed by processing of isomerized gasoline in an etherification zone to produce an oxygenated gasoline product.

The feed stream to the present process contains olefins whose isomer distribution may be changed for a given carbon number by isomerization. Typically the feed stream distills substantially within the gasoline range and has been derived from the cracking of a petroleum-derived feedstock. Alternatively, the feed stream may be derived by synthesis such as the Fischer-Tropsch reaction.

The preferred feed stream is a gasoline-range product derived by the fluid catalytic cracking ("FCC") of petroleum feedstocks heavier than gasoline. The initial boiling point of the FCC gasoline typically is from about 30° to 80° C. and the end point from 100° to 225° C. by the ASTM D-86 test. It may be advantageous in order to avoid feed prefractionation to process a full-range FCC gasoline having an end point of from 150° to 225° C., but gasolines having lower end points contain more olefins and thus will show a greater octane increase from the application of the present isomerization process. The FCC gasoline usually will contain substantially all of the pentenes produced in the FCC process, although it is within the scope of the invention that a portion of the $C_5$ fraction has been removed from the feed stream.

The olefin content of the feed stream generally is in the range of 15 to 60 volume %. Higher olefin contents within this range usually are associated with lower FCC-gasoline end points.

The feed stream to the present process may contain from 0.1 to 5 mass % of highly unsaturated hydrocarbons. Highly unsaturated hydrocarbons include acetylenes and dienes, often formed in high-temperature cracking reactions. In an olefin isomerization process, processing a feed stream containing acetylenes and dienes may require higher operating temperatures, with correspondingly less favorable equilibrium isomer distribution, and also may reduce catalyst life. It is believed that the acetylenes and dienes may form polymer or gum in an isomerization operation, resulting in fouling or coking of the catalyst. In any event, selective reduction of the acetylenes and dienes to produce a stable olefinic stream as isomerization feed has been found to be advantageous.

Clay treating is one means of removing highly unsaturated hydrocarbons from the feed stream. The feed stream is contacted with a clay comprising principally amorphous combinations of silica and alumina such as Fuller's earth, Attapulgas clay, activated bentonite, Superfiltrol, Floridin and the like. Suitable operating conditions include a temperature of from about 150° to 400° C., a pressure of from atmospheric to about 50 atmospheres, and a liquid hourly space velocity of from about 1 to 100. The acetylenes and dienes form polymer, which may remain on the clay or be removed from the product by fractional distillation.

Alternatively, highly unsaturated hydrocarbons may be removed from the feed by selective hydrogenation. This alternative features the advantage of forming valuable olefins rather than polymer from the acetylenes and dienes, but generally is more costly than clay treating. U.S. Pat. No. 3,470,085 teaches an applicable method for removing diolefins from gasoline by selective hydrogenation, and is incorporated herein by reference thereto. Suitable operating conditions include a temperature of from about 20° to 250° C., a pressure of from about 5 atmospheres to 80 atmospheres, and a liquid hourly space velocity of from about 1 to 20. Hydrogen is supplied to the process in an amount sufficient at least to convert diolefins and acetylenes in the feed stream to olefins.

The catalyst for selective hydrogenation preferably comprises one or more metals selected from Groups VIB (6) and VIII (8-10) of the Periodic Table [see Cotton and Wilkinson, Advanced Inorganic Chemistry John Wiley & Sons (Fifth Edition, 1988)] on a refractory inorganic support. One or more of the platinum-group metals, especially palladium and platinum, are highly preferred, and nickel is an alternative metallic component of the catalyst. Alumina is an especially preferred support material.

It is within the scope of the present invention that other means known in the art of removing highly unsaturated hydrocarbons from the feed stream may be employed. U.S. Pat. No. 3,596,436, for example, teaches a process for adsorption of diolefins from a mixture also containing monoolefins and is incorporated herein by reference thereto.

The selective reduction of highly unsaturated hydrocarbons yields a stable olefinic stream as feed to an olefin-isomerization step. Preferably, the level of acetylenes and dienes in the stable olefinic stream has been reduced to about 0.1 mass % or less.

The feed stream, or preferably the stable olefinic stream, is contacted with an isomerization catalyst containing at least one medium-pore molecular sieve having a hereinafter-described butane cracking value of at least about 2 in an olefin-isomerization zone. Contacting may be effected using the catalyst in a fixed-bed system, a moving-bed system, a fluidized-bed system, or in a batch-type operation. In view of the potential attrition loss of the valuable catalyst and of the operational advantages, a fixed-bed system is preferred. The conversion zone may be in one reactor or in separate reactors with suitable means therebetween to ensure that the desired isomerization temperature is maintained at the entrance to each reactor. The reactants may contact the catalyst in the liquid phase, a mixed vapor-liquid phase, or a vapor phase. Preferably, the reactants contact the catalyst in the vapor phase. The contact may be effected in each reactor in either an upward, downward, or radial-flow manner.

The feed stream or stable olefinic stream may contact the catalyst in the absence of hydrogen or in presence of hydrogen in a molar ratio to feed stream of from about 0.01 to 5. Hydrogen may be supplied totally from outside the isomerization process, or the outside hydrogen may be supplemented by hydrogen separated from reaction products and recycled to the charge stock. Inert diluents such as nitrogen, argon, methane, ethane and the like may be present. Although the principal isomerization reaction does not consume hydrogen, there may be net consumption of hydrogen in such side reactions as cracking and olefin saturation. In addition, hydrogen may suppress the formation of carbonaceous compounds on the catalyst and enhance catalyst stability.

It is within the scope of the invention to supply water to the olefin-isomerization zone. Water may be supplied as a liquid, along with the charge stock, or as steam, in conjunction with the hydrogen. It is believed, without limiting the invention, that water may reduce the yield of heavy byproduct and increase catalyst life through reduction of catalyst coking. The water is advantageously supplied in an amount of from about 0.01 to 5 mass % of the feed stream.

Isomerization conditions include reaction temperatures generally in the range of about 50° to 500° C., and preferably from about 100° to 350° C. Lower temperatures favor olefin branched/unbranched equilibrium ratios and mitigate paraffin equilibriation. Reactor operating pressures usually will range from atmospheric to about 50 atmospheres. The amount of catalyst in the reactors will provide an overall weight hourly space velocity of from about 0.5 to 20 $hr^{-1}$, and preferably from about 1 to 10 $hr^{-1}$.

A high yield of $C_5+$ isomerized gasoline is a feature of the invention. The net yield of $C_4$ and lighter products is expected to be less than about 0.5 mass %.

The particular product-recovery scheme employed is not deemed to be critical to the present invention; any recovery scheme known in the art may be used. Typically, the reactor effluent will be condensed and the hydrogen, light hydrocarbons and inerts removed therefrom by flash separation. The condensed liquid product then is fractionated to remove light materials from the isomerized gasoline.

The isomerized gasoline contains an increased proportion relative to the feed of branched olefins, e.g., 2-methyl-1-pentene, relative to unbranched olefins, e.g., 1-hexene. The feed typically will have a ratio of branched to unbranched olefins of about 1, while the ratio in the isomerized gasoline advantageously will be 2 or more. The branched/unbranched ratio is most reliably measured on the pentenes fraction; there are 12 branched and 5 unbranched hexene isomers, and even more isomers of the higher carbon numbers, causing measurement of the ratio to be more difficult and less dependable for these heavier olefins.

In general, the gasoline octane number (knock resistance in an internal combustion engine) is higher for branched than for unbranched olefins; for example, the American Petroleum Institute Research Project 45 shows the following unleaded octane numbers:

| | Research Octane | Motor Octane |
|---|---|---|
| 1-hexene | 76.4 | 53.4 |
| methyl 1-pentenes (average) | 95.3 | 81.2 |

Thus, the isomerized gasoline will have a higher octane number than the isomerization feed.

FCC gasoline usually will contain a ratio of iso-to-normal paraffins that is higher than the equilibrium ratio at isomerization conditions. At an operating temperature of about 290° C. as cited in the examples, the equilibrium isopentane/normal pentane ratio is about 2 and the isohexane/normal hexane ratio is about 3.5 as calculated from free energies. If the paraffins are isomerized in the olefin-isomerization operation, therefore, the octane of the isomerized gasoline will be lowered. An effective isomerization process will avoid equilibriation of the paraffin iso-to-normal ratio, and preferably maintain the isopentane/normal pentane ratio of about 3 or higher.

Part or all of the isomerized gasoline, or a lighter portion of the product derived by fractional distillation of the product, is further upgraded in an etherification zone; optimally all of the isomerized gasoline is processed in the etherification zone. The isomerized gasoline is particularly suitable for etherification, as the increased branching of the olefinic portion generally results in a higher concentration of unsaturated tertiary carbon atoms which are subject to the etherification reaction. In the etherification zone, the tertiary olefin is reacted with one or more of methanol and higher alcohols at etherification conditions using an acidic catalyst to produce the respective ether product. Thus, etherification of the isomerized gasoline will yield a gasoline component having a higher oxygen (ether) content than will etherification of the feed stream to the isomerization zone. The etherification process and catalyst are described hereinbelow and in U.S. Pat. Nos. 4,219,678 and 4,270,929, incorporated herein by reference thereto.

The FIG. 1 is a schematic representation of a combination of isomerization and etherification steps. A catalytically cracked gasoline stream enters the isomerization zone 10 via line 11. Olefins are a major constituent of the gasoline stream. In the isomerization zone, the stream contacts an isomerization catalyst to increase the proportion of branched olefins relative to unbranched olefins in the isomerized gasoline. The branched olefins contain a substantial proportion of tertiary olefins, which react with alcohols to form ethers.

The isomerized gasoline passes via line 12 from the isomerization zone 10 to the etherification zone 20. It is within the scope of the invention that these two zones are closely integrated, i.e., without intermediate separation of reactants or products. One or more monohydroxy alcohols also are fed to the etherification zone via line 21. Ethanol is a preferred monohydroxy-alcohol feed, and methanol is especially preferred. The range of olefins in the isomerized gasoline as well as the variety of alcohols which may be fed to the etherification zone results in a potential range of ethers in the product which may include methyl tertiary amyl ether (MTAE), ethyl tertiary amyl ether (ETAE) and hexyl, heptyl and higher ethers. An oxygenated gasoline product is recovered from the etherification zone via line 22. Unconverted alcohol optionally is removed from the product via line 23, but the alcohol may remain in the gasoline product depending on gasoline blending specifications. Ether formed in the etherification zone may be partially or totally removed from the gasoline, but preferably the ether remains in the gasoline product.

Etherification processes operating with vapor, liquid or mixed-phase conditions may be suitably employed in the etherification zone. The preferred etherification process uses liquid-phase etherification conditions, including a superatmospheric pressure sufficient to maintain the reactants in liquid phase but no more than about 50 atmospheres; pressures of about 10 atmospheres or lower generally are sufficient to maintain liquid-phase conditions. Operating temperature is between about 30° C. and 100° C.; the reaction rate is normally faster at higher temperatures, but conversion is more complete at lower temperatures. High conversion in a moderate volume reaction zone can, therefore, be obtained if the initial section of the reaction zone, e.g., the first two-thirds, is maintained above 70° C. and the remainder of the reaction zone is maintained below 50° C. This may be accomplished most easily with two reactors.

The ratio of feed alcohol to tertiary olefin should normally be maintained in the broad range of 1:1 to 2:1. With the preferred reactants, good results are achieved if the ratio of alcohol to olefin is between 1.05:1 and 1.5:1. An excess of methanol, above that required to achieve satisfactory conversion at good selectivity, should be avoided as some decompostion of methanol to dimethylether may occur with a concomitant increase in the load on separation facilities.

A wide range of materials are known to be effective as etherification catalysts including mineral acids such as sulfuric acid, boron trifluoride, phosphoric acid on kieselguhr, phosphorus-modified zeolites, heteropoly acids, and various sulfonated resins. The use of a sulfonated solid resin catalyst is preferred. These resin type catalysts include the reaction products of phenolformaldehyde resins and sulfuric acid and sulfonated polystyrene resins including those cross-linked with divinylbenzene. An alternative catalyst comprises a zeolite or a non-zeolitic molecular sieve, as described in U.S. Pat. No. 4,740,650 which is incorporated by reference, and preferably includes an inorganic-oxide binder. An effective alternative catalyst comprises zeolite beta, described in U.S. Pat. No. 3,308,069 which is incorporated by reference, and an alumina binder. Further information on suitable etherification catalysts may be obtained by reference to U.S. Pat. Nos. 2,480,940, 2,922,822, and 4,270,929 and the previously cited etherification references.

Several suitable etherification processes have been described in the literature which presently are being used to produce MTBE. The preferred form of the etherification zone is similar to that described in U.S. Pat. No. 4,219,678. In this instance, the olefin-containing feed and alcohol are passed into the etherification zone and contacted at etherification conditions with an acidic etherification catalyst to produce an effluent containing MTBE.

The effluent from the etherification-zone reactor section includes at least product ethers, unconverted hydrocarbons and any excess alcohol. The effluent may also include small amounts of other oxygen-containing compounds such as dimethyl ether and TBA. The effluent may be sent to an alcohol recovery step for the separation of unconverted alcohol, generally methanol, optimally using adsorption with return of the recovered alcohol to the etherification zone. Preferably, however, the effluent is sent to gasoline blending as an oxygenated gasoline component without an alcohol recovery step.

The gasoline component prepared by etherification of isomerized gasoline will contain 1 mass % or more of oxygen on an elemental basis, and generally at least 1.5 mass % oxygen. Often the oxygen content of this component will be 2 mass % or more. Optimally ethers are not intentionally removed from the gasoline component before it is blended into finished gasoline, and instead the oxygen content of the finished gasoline is established by the nature and proportions of other components.

Finished gasoline may be produced by blending the oxygenated gasoline component with other constituents including but not limited to one or more of butanes, butenes, pentanes, naphtha, catalytic reformate, isomerate, alkylate, polymer, aromatic extract, heavy aromatics; gasoline from catalytic cracking, hydrocracking, thermal cracking, thermal reforming, steam pyrolysis and coking; oxygenates from sources outside the combination such as methanol, ethanol, propanol, isopropanol, TBA, SBA, MTBE, ETBE, MTAE and higher alcohols and ethers; and small amounts of additives to promote gasoline stability and uniformity, avoid corrosion and weather problems, maintain a clean engine and improve driveability. The order of blending is not critical to the invention, e.g., one or more of the aforementioned constituents may be blended with the reformate, light naphtha and/or isomerate before these are combined into the present gasoline component, with the ether added as the final major component; the order of blending is not a feature of the invention.

The isomerization catalyst contains at least one medium-pore molecular sieve. The term "medium pore" refers to the pore size as determined by standard gravimetric adsorption techniques in the art of the referenced crystalline molecular sieve between what is recognized in the art as "large pore" and "small pore," see Flanigen et al, in a paper entitled, "Aluminophosphate Molecular Sieves and the Periodic Table", published in the "New Developments in Zeolite Science and Technology" Proceedings of the 7th International Zeolite Conference, edited by Y. Murakami, A. Iijima and J. W. Ward, pages 103–112 (1986). Intermediate pore crystalline molecular sieves have pore sizes between 0.4 nm and 0.8 nm, especially about 0.6 nm or 6 Å for the purposes of this invention crystalline molecular sieves having pores between about 5 and 6.5 Å are defined as "medium-pore" molecular sieves.

An indication of the isomerization activity of the present class of medium-pore molecular sieves is a n-butane cracking value determined using a bench-scale apparatus. The reactor is a cylindrical quartz tube having a length of 254 mm and an I.D. of 10.3 mm. In each test the reactor is loaded with 20–40 mesh (U.S. std.) particles of the molecular sieve in an amount of from 0.5 to 5 grams, the quantity being selected so that the conversion of n-butane is at least 5% and not more than 90% under the test conditions. Samples which are contaminated with organics are first calcined in air to remove organic materials from the pore system, and then are activated in situ in the reactor in a flowing steam of helium at 500° C. for one hour. The n-butane cracking value is determined using a feedstock consisting of a helium-n-butane mixture containing 2 mole percent n-butane which is passed through the reactor at a rate of 50 cc/minute. The feedstock and the reactor effluent are analyzed using conventional gas chromatography techniques. The reactor effluent is analyzed after 10 minutes of on-stream operation. The pseudo-first-order rate constant $k_A$ is calculated from the analytical data.

Preferred crystalline zeolitic aluminosilicates having medium pore sizes include the following:

ZSM-5, characterized as an MFI structure type by the IUPAC Commission on Zeolite Nomenclature. The description of ZSM-5 in U.S. Pat. Nos. 3,702,886 and Re 29,948, and particularly the x-ray diffraction pattern disclosed therein, is incorporated herein by reference thereto.

ZSM-11, characterized as an MEL structure type by IUPAC. The description of ZSM-11 in U.S. Pat. No. 3,709,979, and particularly the x-ray diffraction pattern disclosed therein, is incorporated herein by reference thereto.

ZSM-12, characterized as an MTW structure type by IUPAC. The description of ZSM-12 in U.S. Pat. No. 3,832,449, and particularly the x-ray diffraction pattern disclosed therein, is incorporated by reference thereto.

A highly preferred crystalline zeolite having a composition, expressed in terms of moles of oxides, as follows:

$$0.8\text{–}3.0M_{2/n}O:Al_2O_3:10\text{–}100SiO_2:0\text{–}40H_2O$$

This zeolite is described in U.S. Pat. No. 4,257,885, incorporated herein by reference thereto.

An especially preferred component of the catalyst of the present invention is at least one non-zeolitic molecular sieve, also characterized as "NZMS" and defined in the instant invention to include molecular sieves containing framework tetrahedral units ($TO_2$) of aluminum ($AlO_2$), phosphorus ($PO_2$) and at least one additional element (EL) as a framework tetrahedral unit ($ELO_2$). "NZMS" includes the "SAPO" molecular sieves of U.S. Pat. No. 4,440,871, "ELAPSO" molecular sieves as disclosed in U.S. Pat. No. 4,793,984 and certain "MeAPO", "FAPO", "TAPO" and "ELAPO" molecular sieves, as hereinafter described. Crystalline metal aluminophosphates (MeAPOs where "Me" is at least one of Mg, Mn, Co and Zn) are disclosed in U.S. Pat. No. 4,567,029, crystalline ferroaluminophosphates (FAPOs) are disclosed in U.S. Pat. No. 4,554,143, titanium aluminophosphates (TAPOs) are disclosed in U.S. Pat. No. 4,500,651, metal aluminophosphates wherein the metal is As, Be, B, Cr, Ga, Ge, Li or V are disclosed in U.S. Pat. No. 4,686,093, and binary metal aluminophosphates are described in Canadian Patent 1,241,943. ELAPSO molecular sieves also are disclosed in patents drawn to species thereof, including but not limited to CoAPSO as disclosed in U.S. Pat. No. 4,744,970, MnAPSO as disclosed in U.S. Pat. No. 4,793,833, CrAPSO as disclosed in U.S. Pat. No. 4,738,837, BeAPSO as disclosed in U.S. Pat. No. 4,737,353 and GaAPSO as disclosed in U.S. Pat. No. 4,735,806. The aforementioned patents are incorporated herein by reference thereto. The nomenclature employed herein to refer to the members of the aforementioned NZMSs is consistent with that employed in the aforementioned applications or patents. A particular member of a class is generally referred to as a "−n" species wherein "n" is an integer, e.g., SAPO-11, MeAPO-11 and ELAPSO-31. In the following discussion on NZMSs set forth hereinafter the mole fraction of the NZMS are defined as compositional values which are plotted in phase diagrams in each of the identified patents, published applications or copending applications.

The silicoaluminophosphate molecular sieves described in U.S. Pat. No. 4,440,871 are disclosed as microporous crystalline silicoaluminophosphates, having a three-dimensional microporous framework structure of $PO_2^+$, $AlO_2^-$ and $SiO_2$ tetrahedral units, and whose essential empirical chemical composition on an anhydrous basis is:

$$mR:(Si_xAl_yP_z)O_2$$

wherein "R" represents at least one organic templating agent present in the intracrystalline pore system; "m" represents the moles of "R" present per mole of $(Si_xAl_yP_z)O_2$ and has a value of from 0.02 to 0.3; "x", "y" and "z" represent, respectively, the mole fractions of silicon, aluminum and phosphorus present in the oxide moiety, said mole fractions being within the compositional area bounded by points A, B, C, D and E on the ternary diagram which is FIG. 1 of U.S. Pat. No. 4,440,871, and represent the following values for "x", "y" and "z":

| Point | Mole Fraction x | y | z |
|---|---|---|---|
| A | 0.01 | 0.47 | 0.52 |
| B | 0.94 | 0.01 | 0.05 |
| C | 0.98 | 0.01 | 0.01 |
| D | 0.39 | 0.60 | 0.01 |
| E | 0.01 | 0.60 | 0.39 |

The silicoaluminophosphates of U.S. Pat. No. 4,440,871 are generally referred to therein as "SAPO" as a class, or as "SAPO-n" wherein "n" is an integer denoting a particular SAPO such as SAPO-11, SAPO-31, SAPO-40 and SAPO-41. The especially preferred species SAPO-11 as referred to herein is a silicoaluminophosphate having a characteristic X-ray powder diffraction pattern which contains at least the d-spacings set forth below:

| SAPO-11 | | |
|---|---|---|
| 2r | d | Relative Intensity |
| 9.4-9.65 | 9.41-9.17 | m |
| 20.3-20.6 | 4.37-4.31 | m |
| 21.0-21.3 | 4.23-4.17 | vs |
| 21.1-22.35 | 4.02-3.99 | m |
| 22.5-22.9(doublet) | 3.95-3.92 | m |
| 23.15-23.35 | 3.84-3.81 | m-s |

MeAPO molecular sieves are crystalline microporous aluminophosphates in which the substituent metal is one of a mixture of two or more divalent metals of the group magnesium, manganese, zinc and cobalt and are disclosed in U.S. Pat. No. 4,567,029. Members of this novel class of compositions have a three-dimensional microporous crystal framework structure of $MO^{-2}_2$, $AlO^{-}_2$ and $PO_2+$ tetrahedral units and have an essential empirical chemical composition, on an anhydrous basis, of:

$$mR:(M_xAl_yP_z)O_2$$

wherein "R" represents at least one organic templating agent present in the intracrystalline pore system; "m" represents the moles of "R" present per mole of $(M_xAl_yP_z)O_2$ and has a value of from zero to 0.3, the maximum value in each case depending upon the molecular dimensions of the templating agent and the available void volume of the pore system of the particular metal aluminophosphate involved; "x", "y", and "z" represent the mole fractions of the metal "M", (i.e., magnesium, manganese, zinc and cobalt), aluminum and phosphorus, respectively, present as tetrahedral oxides, said mole fractions being such that they are within the following limiting values for "x", "y", and "z":

| | Mole Fraction | | |
|---|---|---|---|
| Point | x | y | z |
| A | 0.01 | 0.60 | 0.39 |
| B | 0.01 | 0.39 | 0.60 |
| C | 0.35 | 0.05 | 0.60 |
| D | 0.35 | 0.60 | 0.05 |

when synthesized the minimum value of "m" in the formula above is 0.02.

An alternative component of the catalyst of the present invention is one or more of TASO, or titanium-aluminum-silicon-oxide molecular sieves having three-dimensional microporous crystal framework structures of $TiO_2$, $AlO_2$ and $SiOP_2$ tetrahedral units. TASO molecular sieves have a unit empirical formula on an anhydrous basis of:

$$mR(Ti_xAl_ySi_z)O_2$$

wherein "R" represents at least one organic templating agent present in the intracrystalline pore system; "m" represents the moles of "R" present per mole of $(Ti_xAl_ySi_z)O_2$ and has a value of between zero and about 0.3, the maximum value in each case depending upon the molecular dimensions of the templating agent and the available void volume of pore system of the particular TASO molecular sieve; and "x", "y" and "Z" represent the mole fractions of titanium, aluminum and silicon, respectively, present as tetrahedral oxides, said mole fractions being such that they are within the following limiting values for "x", "y" and "z":

| | Mole Fraction | | |
|---|---|---|---|
| Point | x | y | z |
| A | 0.39 | 0.60 | 0.01 |
| B | 0.98 | 0.01 | 0.01 |
| C | 0.01 | 0.01 | 0.98 |
| D | 0.01 | 0.60 | 0.39 |
| E | 0.01 | 0.40 | 0.50 |
| F | 0.49 | 0.01 | 0.50 |

TASO molecular sieves are described in U.S. Pat. No. 4,707,345, incorporated herein by reference thereto.

It is within the scope of the invention that the catalyst comprises two or more medium-pore molecular sieves. Preferably the molecular sieves are as a multi-compositional, multi-phase composite having contiguous phases, a common crystal framework structure and exhibiting a distinct heterogeneity in composition, especially wherein one phase comprises a deposition substrate upon which another phase is deposited as an outer layer. Such composites are described in U.S. Pat. No. 4,861,739, incorporated herein by reference thereto.

The molecular sieve preferably is combined with a binder for convenient formation of catalyst particles. The binder should be porous, adsorptive support having a surface area of about 25 to about 500 $m^2/g$, uniform in composition and relatively refractory to the conditions utilized in the hydrocarbon conversion process. By the term "uniform in composition," it is meant that the support be unlayered, have no concentration gradients of the species inherent to its composition, and be completely homogeneous in composition. Thus, if the support is a mixture of two or more refractory materials, the relative amounts of these materials will be constant and uniform throughout the entire support. It is intended to include within the scope of the present invention carrier materials which have traditionally been utilized in hydrocarbon conversion catalysts such as: (1) refractory inorganic oxides such as alumina, titanium dioxide, zirconium dioxide, chromium oxide, zinc oxide, magnesia, thoria, boria, silica-alumina, silica-magnesia, chromia-alumina, alumina-boria, silica-zirconia, etc.; (2) ceramics, porcelain, bauxite; (3) silica or silica gel, silicon carbide, clays and silicates including those synthetically prepared and naturally occurring, which may or may not be acid treated, for example attapulgus clay, diatomaceous earth, fuller's earth, kaolin, kieselguhr, etc.; (4) crystalline zeolitic aluminosilicates, either naturally occurring or synthetically prepared such as FAU, MEL, MFI, MOR, MTW (IUPAC Commission on Zeolite Nomenclature), in hydrogen form or in a form which has been exchanged with metal cations, (5) spinels such as $MgAl_2O_4$, $FeAl_2O_4$, $ZnAl_2O_4$, $CaAl_2O_4$, and other like compounds having the formula $MO\text{-}Al_2O_3$ where M is a metal having a valence of 2; and (6) combinations of materials from one or more of these groups.

The preferred binder to effect a selective finished catalyst is a form of amorphous silica. The preferred amorphous silica is a synthetic, white, amorphous silica (silicon dioxide) powder which is classed as wet-process, hydrated silica. This type of silica is produced by a chemical reaction in a water solution, from which it is precipitated as ultra-fine, spherical particles. It is preferred that the BET surface area of the silica is in the range from about 120 to 160 $m^2/g$. A low content of sulfate salts is desired, preferably less than 0.3 wt. %. It is especially preferred that the amorphous silica binder be nonacidic, e.g., that the pH of a 5% water suspension be neutral or basic (pH about 7 or above).

The molecular sieve and binder are combined to form an extrudable dough, having the correct moisture content to allow for the formation of extrudates with acceptable integrity to withstand direct calcination. Extrudability is determined from an analysis of the moisture content of the dough, with a moisture content in the range of from 30 to 50 wt. % being preferred. Extrusion is performed in accordance with the techniques well known in the art. A multitude of different extrudate shapes are possible, including, but not limited to, cylinders, cloverleaf, dumbbell and symmetrical and asymmetrical polylobates. It is also within the scope of this invention that the extrudates may be further shaped to any desired form, such as spheres, by any means known to the art.

An optional component of the present catalyst is a platinum-group metal including one or more of platinum, palladium, rhodium, ruthenium, osmium, and iridium. The preferred platinum-group metal component is platinum. The platinum-group metal component may exist within the final catalyst composite as a compound such as an oxide, sulfide, halide, oxysulfide, etc., or as an elemental metal or in combination with one or more other ingredients of the catalyst. It is believed that the best results are obtained when substantially all the platinum-group metal component exists in a reduced state. The platinum-group metal component could comprise up to about 2 mass % of the final catalytic composite, calculated on an elemental basis. However, more advantageously the isomerization catalyst is essentially free of platinum-group metal or contains such metals in concentrations of from 1 to 100 mass parts per million (ppm).

The optional platinum-group metal component may be incorporated into the catalyst composite in any suitable manner. The method of incorporation normally involves the utilization of a water-soluble, decomposable compound of a platinum-group metal to impregnate the calcined zeolite/binder composite. For example, the platinum-group metal component may be added to the calcined hydrogel by commingling the calcined composite with an aqueous solution of chloroplatinic or chloropalladic acid.

It is within the scope of the present invention that the catalyst may contain other metal components known to modify the effect of an optional platinum-group metal component as well as the range of framework metals described hereinabove. Such metal modifiers may include rhenium, tin, germanium, lead, cobalt, nickel, indium, gallium, zinc, uranium, dysprosium, thallium, and mixtures thereof. Catalytically effective amounts of such metal modifiers may be incorporated into the catalyst by any means known in the art.

The catalyst of the present invention optionally may contain a halogen component. The halogen component is fluorine, chlorine, bromine or iodine or mixtures thereof, with chlorine being preferred. The optional halogen component is generally present in a combined state with the inorganic-oxide support, is well dispersed throughout the catalyst, and may comprise from more than 0.2 to about 15 wt. %, calculated on an elemental basis, of the final catalyst.

The optional halogen component may be incorporated in the catalyst in any suitable manner, either during the preparation of the inorganic-oxide support or before, while or after other catalytic components are incorporated. For example, the carrier material may contain halogen and thus contribute at least some portion of the halogen content in the final catalyst. The halogen component or a portion thereof also may be added to the catalyst during the incorporation of other catalyst components into the support, for example, by using chloroplatinic acid in impregnating a platinum component. Also, the halogen component or a portion thereof may be added to the catalyst by contacting with the halogen or a compound, solution, suspension or dispersion containing the halogen before or after other catalyst components are incorporated into the support. Suitable compounds containing the halogen include acids containing the halogen, e.g., hydrochloric acid. The halogen component or a portion thereof may be incorporated by contacting the catalyst with a compound, solution, suspension or dispersion containing the halogen in a subsequent catalyst regeneration step.

The catalyst composite is dried at a temperature of from about 100° to about 320° C. for a period of from about 2 to about 24 or more hours and calcined at a temperature of from 400° to about 650° C. in an air atmosphere for a period of from about 0.1 to about 10 hours until any metallic compounds present are converted substantially to the oxide form. The optional halogen component may be adjusted by including a halogen or halogen-containing compound in the air atmosphere.

The resultant calcined composite may be subjected to a substantially water-free reduction step to insure a uniform and finely divided dispersion of the optional metallic components. Preferably, substantially pure and dry hydrogen (i.e., less than 20 vol. ppm $H_2O$) is used as the reducing agent in this step. The reducing agent contacts the catalyst at conditions, including a temperature of from about 200° to about 650° C. and for a period of from about 0.5 to about 10 hours, effective to reduce substantially all of the platinum-group metal component to the metallic state.

EXAMPLES

The following examples are presented to demonstrate the present invention and to illustrate certain specific embodiments thereof. These examples should not be construed to limit the scope of the invention as set forth in the claims. There are many possible other variations, as those of ordinary skill in the art will recognize, which are within the spirit of the invention.

The examples illustrate the conversion of olefins in FCC gasoline feedstocks to more highly branched isomers. The FCC gasoline had the following characteristics:

| | |
|---|---|
| ASTM D-86 end point, °C. | 207 |
| Vol. % paraffins | 34.8 |
| olefins | 36.8 |
| naphthenes | 7.9 |
| aromatics | 20.4 |

Catalysts were evaluated using a 1¼-inch stainless-steel reactor. 20 grams of bound catalyst as 1/16" extrudates were placed in the reactor. Olefin-rich feedstock was charged to the reactor. The reaction temperature was monitored by five thermocouples in the catalyst bed and controlled by adjusting the power input to the reactor furnace. Liquid products were separated and collected. Gas output was monitored and sampled when greater than 0.1 l/hr. The liquid products were analyzed by vapor-phase chromatography.

Catalyst performance was compared by examining the ratio of branched to unbranched olefins ("B/U") in each product. Iso-to-normal paraffin ratios ("I/N") also are reported for catalysts of the invention, in order to show the extent of undesirable equilibriation. Results also were reported for product Research octane numbers ("RON") and Motor octane numbers ("MON"), knock resistance of fuels at different test conditions.

EXAMPLE I

The process of the present invention was demonstrated by effecting isomerization of olefins in gasoline from a fluid catalytic cracking unit, utilizing a synthetic crystalline zeolitic molecular sieve catalyst as described in U.S. Pat. No. 4,257,885. The specific catalyst sample used in the test had the following approximate composition in mass %:

| | |
|---|---|
| $Al_2O_3$ | 41.7 |
| $P_2O_5$ | 50.5 |
| $SiO_2$ | 7.8 |
| | 100.0 |

Tests were performed and results measured based on the feed stream described hereinabove. The feed stream was treated using Fuller's earth at a temperature of 260° C. to produce feed to the isomerization step. The clay-treated isomerization feed contacted the isomerization catalyst at the following condition:

| | |
|---|---|
| Temperature, °C. | 288° |
| WHSV, $hr^{-1}$ | 1.12 |
| Pressure, atm. | 2.9 |

Results were as follows, comparing yield branched/unbranched ratio ("B/U"), and octanes:

| | Feed | Product |
|---|---|---|
| $C_5$ + yield, mass % | 100.0 | 99.6 |
| B/U: pentenes | 1.09 | 3.97 |
| hexenes | 1.31 | 1.96 |
| I/N: pentanes | 5.14 | 5.46 |
| hexanes | 7.90 | 8.22 |
| RON clear | 91.2 | 91.5 |
| MON clear | 79.5 | 80.0 |

The significant isomerization of olefins thus was accomplished while avoiding reversion of paraffin iso-/normal ratios to equilibrium values.

EXAMPLE II

A control test of the prior art was carried out to demonstrate the utility of the invention. The FCC gasoline feed and the SAPO-11 catalyst were the same as used in Example I in order to provide a reliable comparison of the invention and the prior art. The untreated feedstock contacted the isomerization catalyst at the following conditions:

| | |
|---|---|
| Temperature, °C. | 288° C. |

-continued

| | |
|---|---|
| WHSV, $hr^{-1}$ | 1.10 |
| Pressure, atm. | 3.0 |

Results were as follows, comparing yield and branched-/unbranched ratio ("B/U").

| | Feed | Product |
|---|---|---|
| $C_5$ + yield, mass % | 100 | 100 |
| B/U: pentenes | 1.04 | 1.04 |
| hexenes | 1.31 | 1.00 |
| I/N: pentanes | 6.36 | 6.13 |
| hexanes | 8.54 | 8.44 |

The low ratio of branched to unbranched olefins in the product compared to the results presented in Example I demonstrate the benefits of the process of the invention.

EXAMPLE III

The process of the invention was demonstrated using as isomerization catalyst a preferred crystalline zeolite as described hereinabove and in U.S. Pat. No. 4,257,885. The zeolite had the following approximate composition in mass %:

| | |
|---|---|
| $Al_2O_3$ | 4.3 |
| $SiO_2$ | 95.6 |
| CaO | 0.1 |
| | 100.0 |

Tests were performed and results measured based on the feed stream described hereinabove. The feed stream was treated using Fuller's earth at a temperature of 260° C. to produce feed to the isomerization step. The clay-treated isomerization feed contacted the isomerization catalyst at the following conditions with the following results:

| | Feed | Product | |
|---|---|---|---|
| Temperature, °C. | | 262° | 286° |
| WHSV, $hr^{-1}$ | | 1.10 | 1.11 |
| Pressure, atm. | | 2.4 | 2.3 |
| $C_5$ + yield, mass % | 100.0 | 100.0 | 100.0 |
| B/U: pentenes | 1.01 | 3.95 | 4.23 |
| hexenes | 0.98 | 2.21 | 2.20 |
| I/N: pentanes | 6.68 | 6.16 | 6.27 |
| hexanes | 8.67 | 8.58 | 8.62 |
| RON clear | 91.1 | 92.6 | 92.8 |
| MON clear | 79.0 | 79.7 | 80.1 |

EXAMPLE IV

The process of the invention was demonstrated using as isomerization catalyst a titanium-aluminum-silicon-oxide (TASO) as described hereinabove and in U.S. Pat. No. 4,707,345. The catalyst had the following approximate composition in mass %:

| | |
|---|---|
| $TiO_4$ | 13.9 |
| $Al_2O_3$ | 3.6 |
| $SiO_2$ | 82.5 |
| | 100.0 |

Tests were performed and results measured based on the feed stream described hereinabove. The feed stream was treated using Fuller's earth at a temperature of 260° C. to produce feed to the isomerization step. The clay-treated isomerization feed contacted the isomerization catalyst at the following conditions with the following results:

| | Feed | Product | |
|---|---|---|---|
| Temperature, °C. | | 261° | 291° |
| WHSV, $hr^{-1}$ | | 1.14 | 1.13 |
| Pressure, atm. | | 2.7 | 2.8 |
| $C_5$ + yield, mass % | 100.0 | 100.0 | 100.0 |
| B/U: pentenes | 0.97 | 2.07 | 3.15 |
| hexenes | 0.94 | 1.78 | 2.02 |
| I/N: pentanes | 6.13 | 6.48 | 6.51 |
| hexanes | 8.71 | 8.95 | 8.92 |
| RON clear | 89.5 | — | 90.8 |
| MON clear | 78.9 | — | 80.0 |

EXAMPLE V

The feed and product streams of Example III were subjected to etherification in order to determine the effect of the present process on the potential oxygen content of the gasoline. The combined feed to etherification was a mixture of 13 mass % methanol and 87 mass % gasoline. The combined feed was processed in a reactor containing a fixed bed of a strong-acid resin catalyst, Amberlyst-15, available from Rohm and Haas Co., Philadelphia, Pa. Etherification was carried out a temperature ranging around 60° C. and a pressure of about 14 atmospheres gauge in all cases.

Figure 2:
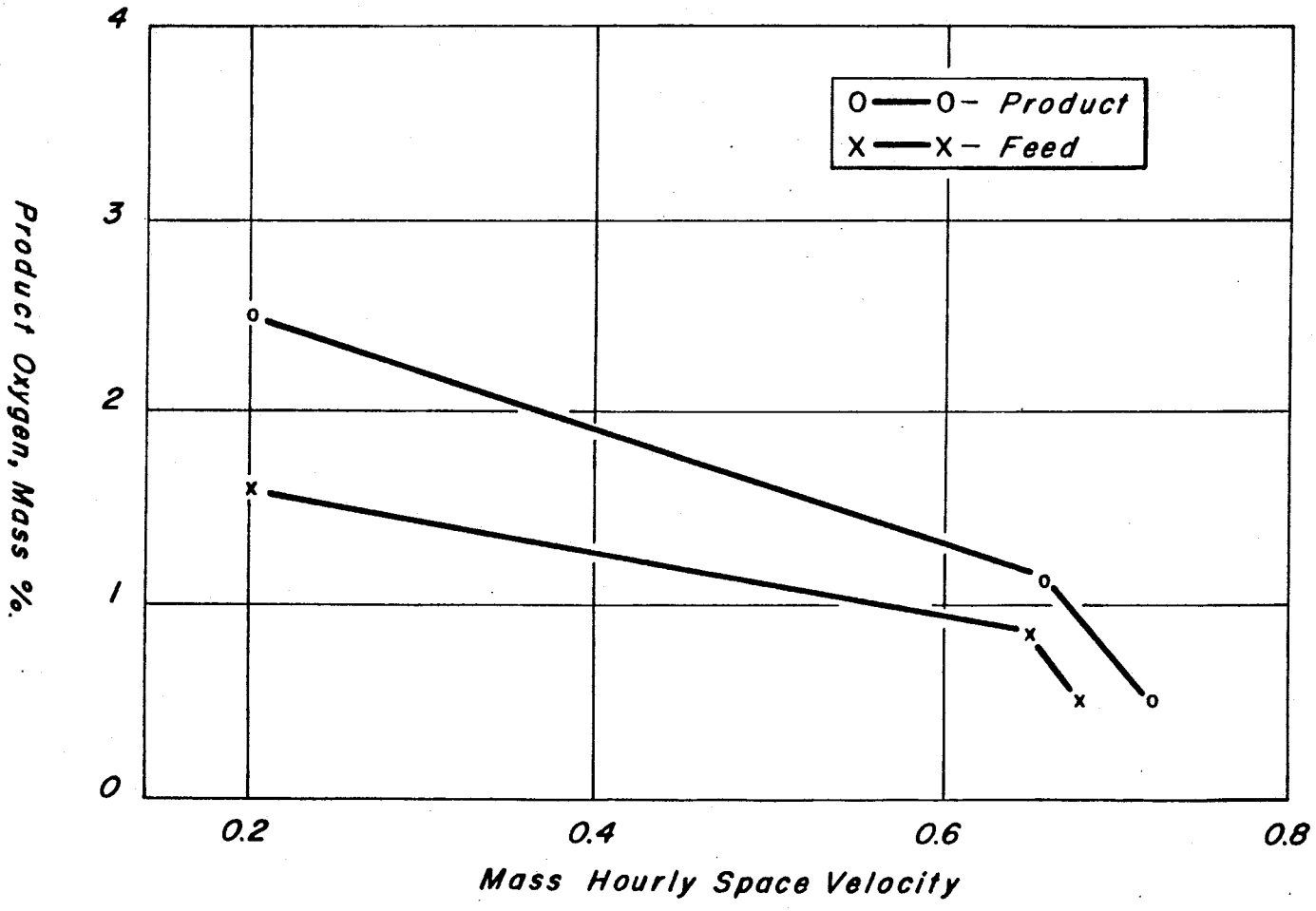
FIG. 2 compares the oxygen content of gasolines produced by the etherification of the feed to and the product from an isomerization zone at varying etherification space velocities.

Six tests were recorded, three for each of the isomerization feed and product over a range of mass hourly space velocities of from 0.7 to 0.2. The oxygen content was determined by known methods for the product of each etherification test. The comparative results were plotted and are shown as FIG. 2.

At low space velocities, i.e., below 0.4, where the oxygen content of the etherified isomerized product of the invention was about 2 mass % or higher, the improvement in attainable oxygen content by isomerizing the gasoline from catalytic cracking was about 50% or higher. Even at high space velocities, the improvement was at least about 35%. The maximum product oxygen content of 2.5 mass % achieved by the process of the invention compares with industry gasoline oxygen contents of 2–2.7 mass % maximum, and this product therefore should be useful in meeting changing gasoline needs.

EXAMPLE VI

Etherification of the isomerized product of Example I was carried out as described in Example V except that the etherification catalyst comprised an extrudate of 80 mass % zeolite beta and 20 mass % Ziegler alumina binder. The etherification was carried out at a mass hourly space velocity of about 0.7. The oxygen content of the etherification product was about 1.3 mass %, comparing favorably with the results of Example V using Amberlyst-15 catalyst.

We claim:

1. A process combination for increasing the oxygen content of an olefin-containing gasoline-range feed stream produced by a catalytic cracking process and having an initial boiling point of at least about 30° C. and an end point of at least 100° C. comprising the steps of:

(a) selectively reducing the content of highly unsaturated hydrocarbons in the feed stream to produce a stable olefinic stream, and (b) contacting the stable olefinic stream at olefin-isomerization conditions with an isomerization catalyst comprising at least one medium-pore molecular sieve to produce an isomerized gasoline, and (c) contacting at least a portion of the isomerized gasoline with a monohydroxy alcohol in an etherification zone containing an etherification catalyst at liquid-phase etherification conditions to obtain an oxygenated gasoline component.

2. The process combination of claim 1 wherein the isomerization catalyst comprises an inorganic-oxide matrix.

3. The process combination of claim 1 wherein the molecular sieve comprises at least one synthetic crystalline zeolitic molecular sieve.

4. The process combination of claim 1 wherein the molecular sieve comprises at least one non-zeolitic molecular sieve.

5. The process combination of claim 1 wherein the olefin-isomerization conditions comprise a pressure of from about atmospheric to 50 atmospheres, a temperature of from about 50° to 500° C., and a liquid hourly space velocity of from about 0.5 to 20.

6. The process combination of claim 6 wherein the temperature is from about 100° to 350° C.

7. The process combination of claim 1 wherein the isomerized gasoline has a ratio of branched to unbranched olefins of at least about 2.

8. The process combination of claim 1 wherein the isomerized gasoline has a ratio of branched to unbranched olefins of at least about 3.

9. The process combination of claim 1 wherein the net yield of $C_4$ and lighter products in the isomerization zone is less than about 0.5 mass %.

10. The process of claim 1 wherein substantially the entire isomerized gasoline is contacted with an alcohol in the etherification zone.

11. The process combination of claim 1 wherein the etherification catalyst comprises a sulfonated solid resin.

12. The process combination of claim 1 wherein the etherification catalyst comprises zeolite beta.

13. The process combination of claim 1 further comprising blending the oxygenated gasoline component with other constituents to obtain a finished gasoline.

14. The process combination of claim 13 wherein ethers are not removed intentionally from the gasoline component before blending the component with other constituents.

15. The finished gasoline obtained by the process combination of claim 13.

16. The process combination of claim 1 wherein step (a) comprises clay treating of the feed stream at clay-treating conditions to polymerize highly unsaturated hydrocarbons.

17. The process combination of claim 1 wherein step (a) comprises a polymer-removal step.

18. The process combination of claim 1 wherein step (a) comprises selective hydrogenation of the highly unsaturated hydrocarbons at selective-hydrogenation conditions.

* * * * *